US006189898B1

(12) United States Patent
Benoit

(10) Patent No.: US 6,189,898 B1
(45) Date of Patent: Feb. 20, 2001

(54) REINFORCED FRAME FOR A ROLLER SKATE

(75) Inventor: Louis Benoit, La Balme de Sillingy (FR)

(73) Assignee: Salomon S.A., Metz-Tessy (FR)

( * ) Notice: Under 35 U.S.C. 154(b), the term of this patent shall be extended for 0 days.

(21) Appl. No.: 09/147,022

(22) PCT Filed: Mar. 12, 1997

(86) PCT No.: PCT/FR97/00441

§ 371 Date: Sep. 11, 1998

§ 102(e) Date: Sep. 11, 1998

(87) PCT Pub. No.: WO97/33666

PCT Pub. Date: Sep. 18, 1997

(30) Foreign Application Priority Data

Mar. 14, 1996 (FR) ..... 96 03364

(51) Int. Cl.[7] ..... A63C 17/06

(52) U.S. Cl. ..... 280/11.221; 280/11.231; 280/11.27

(58) Field of Search ..... 280/11.19, 11.22, 280/11.23, 11.27, 11.28, 11.221, 11.231

(56) References Cited

U.S. PATENT DOCUMENTS

| | | | | |
|---|---|---|---|---|
| 3,086,787 | | 4/1963 | Wyche . | |
| 3,756,614 | | 9/1973 | Grubin . | |
| 5,388,846 | | 2/1995 | Gierveld . | |
| 5,411,278 | | 5/1995 | Wittman | 280/11.22 |
| 5,533,740 | * | 7/1996 | Lin | 280/11.2 |
| 5,720,488 | * | 2/1998 | Foffano et al. | 280/11.22 |
| 5,797,610 | * | 8/1998 | Grande et al. | 280/11.22 |
| 5,799,955 | * | 9/1998 | Iverson | 280/11.22 |
| 5,803,466 | * | 9/1998 | Wrike | 280/11.27 X |
| 5,915,703 | * | 6/1999 | Wrike | 280/11.27 X |
| 5,934,693 | * | 8/1999 | Nicoletti | 280/11.22 |

FOREIGN PATENT DOCUMENTS

| | | |
|---|---|---|
| 1033569 | 7/1958 | (DE) . |
| 0774282 | 5/1997 | (EP) . |
| 2679781 | 2/1993 | (FR) . |

* cited by examiner

*Primary Examiner*—Michael Mar
(74) *Attorney, Agent, or Firm*—Greenblum & Bernstein, P.L.C.

(57) ABSTRACT

A frame for skates and the like iwth a structure that includes at least one bearing surface engageable by a boot or the like, and a side flange. One or more ground-engaging members are attached to the frame. The components of the structure of the frame are made of at least two at least partially mutually assembled materials having different mechanical properties.

44 Claims, 5 Drawing Sheets

Fig: 1
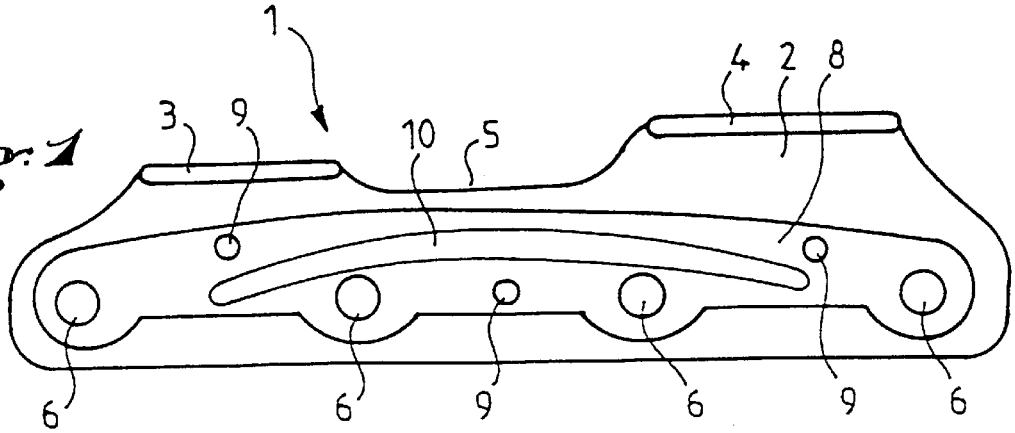
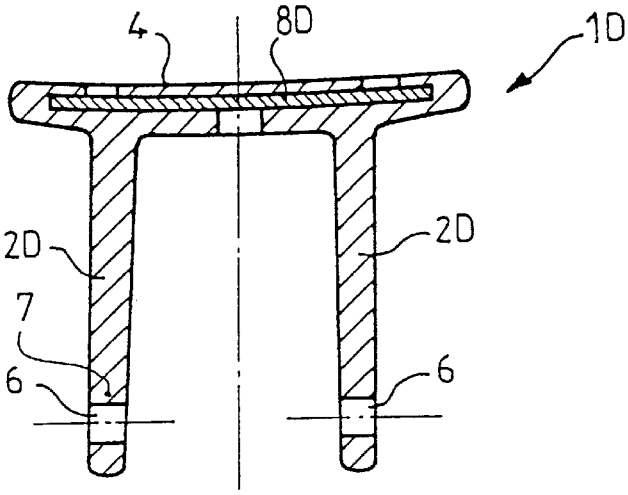
Fig: 2
Fig: 3
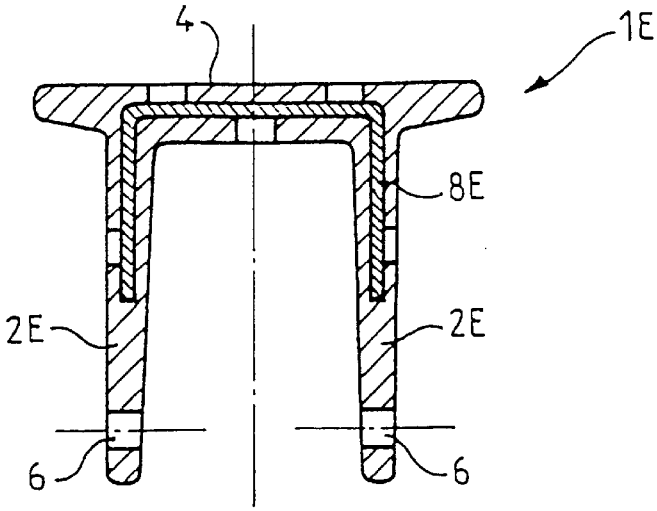

REINFORCED FRAME FOR A ROLLER SKATE

BACKGROUND OF THE INVENTION

1. Field of the Invention

The present application relates to a frame for gliding sport articles such as roller skates, ice skates.

2. Description of Background and Relevant Information

The frames of the aforementioned type are adapted for the linkage between one or more gliding members themselves (namely the ice skate blade, wheels or rollers) and the user's foot between which it is inserted.

The frames are therefore generally constituted by a bearing surface capable of receiving the athlete's shoe, and by one or two longitudinal lateral flanges adapted to receive the wheels, rollers or the skate blade.

They must also have substantial mechanical resistance characteristics while being as light as possible in order not to require too substantial efforts from the athlete.

Furthermore, the advanced technology in these gliding sport articles, especially in the case of in-line roller skates, further increases the requirements, which must be met by the skate frames, and which must reach a compromise between:

- an increased mechanical resistance and stability, especially for the speed skates, but also for the so-called "free ride", "free style" or "hockey" skates, in order to offer efficiency and an unquestionable response in the transmission of movements to the skate by the skater;
- a certain flexibility, especially in certain zones of the skate to allow for an adaptation of the shape of the skate to the path taken, especially on curves at high speeds, but also the dampening of shocks and vibrations,
- as light a weight as possible.

Furthermore, it is known that the front wheels are the first to receive the ground impacts, whereas the rear wheels transmit the most power.

Currently known techniques for making frames do not allow meeting all these requirements while maintaining a reasonable manufacturing cost.

Indeed, the oldest manufacturing technique consists of making such frames from folded sheet metal, in a U-shape, as shown in the German patent DE 10 33 569, for example.

Such a construction method, although inexpensive, does not, however, allow obtaining frames with great mechanical resistance except by substantially increasing the thickness of the sheet metal and therefore its weight, and it allows obtaining a certain flexibility in selected areas even less.

Another commonly used technique consists of making the frames entirely by molding from synthetic or even metallic materials. The integral molding offers the advantage of allowing sufficiently varied forms, but furthermore presents numerous disadvantages, the main disadvantage being the impossibility of the compromise sought and cited previously, for even if the constitutive material of the frame has characteristics of stiffness, it cannot offer at the same time characteristics of flexibility, except by providing zones that are more or less thick according to their function, but this would lead to molds having a burdensome design because it is complicated.

In this field, frames made from composite fibers are also known. Such frames can actually be made in almost any shape possible, but their construction is extremely expensive and hard to industrialize. Moreover, such frames are certainly very stiff but lack flexibility and are therefore fragile and uncomfortable.

Finally, U.S. Pat. No. 5,388,846 proposed making a frame for an ice skate or a roller skate from a sectioned metallic bar whose transverse section corresponds to the general section desired for the frame, the final shape of the frame being obtained after machining with removal of material.

Such a construction method is again very expensive, given the machining time necessary and the quantity of material that must be removed. In addition, it does not allow great freedom with respect to the shape or profile of the frame, nor in seeking the mentioned compromise.

U.S. Pat. No. 3,086,787 from C. A. Wyche relates to a roller skate with an adjustable length whose stability and stiffness are ensured regardless of the number of rollers and the distance separating the front and rear rollers. The skate comprises a support plate bent in an inverted U-shape, preferably made of fairly thin steel on which elements are slidably mounted for maintaining the heel and tip of the foot. To each of the side portions of the support plate, there is welded or screwed a downwardly extending metal plate, preferably made of hardened steel and extending the full length of the skate.

SUMMARY OF THE INVENTION

The object of the present invention is to overcome these drawbacks and to provide an improved frame for gliding sport articles which allow resolving the various problems previously mentioned and, in particular, combining the characteristics of mechanical resistance, adaptability, construction flexibility, lightness and low manufacturing costs.

This object is achieved with the frame according to the invention, which comprises at least one bearing surface adapted to receive a shoe and at least one lateral flange provided with means for attaching at least one gliding member, wherein at least one portion is made of plastic that covers, at least partly, a reinforcement having mechanical characteristics different from the plastic portion.

BRIEF DESCRIPTION OF THE DRAWINGS

In any case, the invention will be better understood and other characteristics thereof will be shown with the following description; with reference to the attached schematic drawings representing, by way of non-limiting examples, several frame embodiments, and in which:

FIG. 1 is a side view of a reinforced frame generally represented according to an example of the invention;

FIGS. 2–6 are transverse cross-sectional views of a frame according to different embodiments;

DETAILED DESCRIPTION OF THE INVENTION

Figure 4:
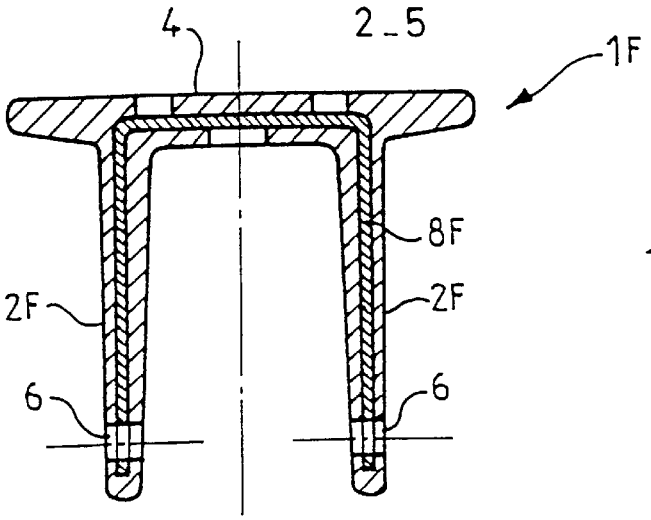

As shown in FIG. 1, the frame 1 according to the invention is made at least in part of plastic and is generally presented in the form of two lateral flanges 2 connected together by two platforms 3 and 4 or boot bearing members which give the assembly a substantially U-shaped transverse section.

Each of these platforms 3 and 4 constitutes a bearing surface capable of receiving the athlete's shoe, the latter (not shown) being attached by any known means, especially glue, rivets, screws, etc., but it can also be attached in a removable manner by non-permanent connecting means.

It is also noted that the platforms 3 and 4 are distinct and separated from each other by a cutout 5, and are positioned at different levels of height, the platform 4 being higher than the platform 3, to take into account the natural position of the athlete, the heel being slightly elevated. Of course, they could also be positioned at the same level.

Each flange 2 has a straight elongated form, but it can also be slightly bent in an arc of a circle in the longitudinal direction.

At the lower end of each flange, holes 6 are provided for attaching rollers, or as the case may be, a skate blade.

Each hole 6 is made in a cylindrical boss 7 capable of being obtained by die casting, boring, etc. The holes 6 positioned correspondingly in the two flanges 2 are coaxial.

According to the invention, the constituent parts of the previously mentioned structure constituting the frame 1, namely the bearing surface 3 and 4 and the flanges 2, are made from at least two materials of different mechanical characteristics, at least partially attached onto or into one another.

In this case, but in a non-limiting way, it is the flanges 2 which, at least in part, are made of a material different from the rest of the structure.

Indeed, the invention can relate to other parts of the frame as this will be described later.

In the example of FIGS. 1 and 2, the lateral flanges 2 are parallel with respect to one another to form a "U" with the bearing surface 3 and 4 and are made of the same material as the bearing surfaces, but they are doubled by external reinforcements 8 made of a different material capable of modifying the mechanical characteristics of the assembly thus obtained.

For example, the reinforcements 8 are metallic, whereas the rest of the structure is obtained by molding a plastic material, but it can very well be imagined that the reinforcements 8 be obtained from a plastic material with predetermined mechanical characteristics, whereas the rest of the structure is also made from a plastic material with different characteristics.

The metallic reinforcements 8 are obtained by cutting and stamping, then attached to the flanges 2 by any means.

According to the invention, the metallic reinforcements 8 are attached to the flanges 2 by molding when the latter are molded.

Such reinforcements 8 also have the advantage of comprising, at their lower ends, the bored and threaded boss 7, to allow attaching, without any intermediate piece, of the gliding members on a stiff metallic zone, or further on hard plastic where the reinforcements 8 would be made of a loaded plastic rather than a flexible plastic constituting the rest of the structure.

Advantageously, the metallic reinforcements 8 comprise, in their longitudinal direction, stiffening ribs obtained by stamping, extending substantially along the whole length of the flange 2 and having a generally bent shape.

Such a characteristic allows, at equal stiffness, dividing the thickness and therefore the weight of the reinforcement 8 practically in half Regardless of the example described hereinafter, an improvement of the torsional and flexional stiffness of the frame is obtained due to the reinforcement elements. Of course, these can be arranged between the inside and the outside of the frame so as to optimize the necessary mechanical characteristics thereof It is also possible to have a reinforcement on one side only of the frame, since it is known that the maximum of the forces transmitted by the skater to the wheels pass through the inside skirt or flange of the frame. That is also why certain examples envision using different materials between the internal flange and the external flange.

In the embodiment example of FIG. 2, the frame ID comprises bearing surfaces 3, 4 obtained integrally with parallel lateral flanges 2D, forming a U with the bearing surfaces, through plastic molding including through molding or co-injection, an internal reinforcement 8D embedded on or in the bearing 3, 4, and made of a metallic material or a plastic material different from the preceding one. Such a construction is, of course, compatible with the bearing surfaces 3, 4 positioned at different levels.

Thus, a structure whose bearing surface alone is stiffened is obtained, whereas the flanges maintain a certain flexibility.

In the examples of the invention shown in FIGS. 3–7, the frame 1E, 1F, 1G, 1H is generally constituted by a bearing surface 3, 4, and two lateral flanges 2E, 2F, 2G, 2H, parallel with respect to one another and forming a U with the bearing surface, this structure being obtained by molding a plastic material around at least one reinforcement 8E, 8F, 8G, 8H, made of metal or a plastic material different from the first, arranged inside the flanges.

More particularly, according to FIG. 3, the reinforcement 8E forms a U extending, on the one hand, inside the bearing plane 4, and, on the other hand, inside the lateral flanges 2E by their parallel arms, the end of the latter being positioned on this side of the end parts of the flanges 2E which are bored with holes 6 and threaded to ensure the attachment of the gliding members.

However, according to the alternative embodiment shown in FIG. 4, the reinforcement 8F forms a U extending, on the one hand, inside the bearing plane 4, and, on the other hand, inside the lateral flanges 2F by their parallel arms, the end of the latter extending beyond the end parts of the flanges 2F which are bored with holes 6 and threaded to ensure the attachment of the gliding members. This last solution offers the advantage of creating reinforcements at the level of the holes 6.

Figure 5:
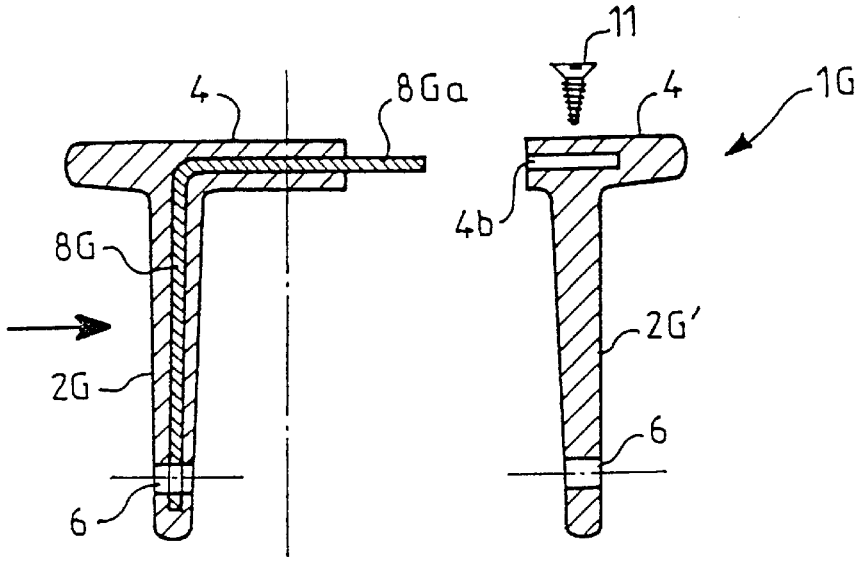

According to the example of FIG. 5, the frame 1G is constituted of two parts, the first part integrating a reinforcement 8G molded in a portion of the bearing surface 4 and a flange 2G, generally perpendicular to the portion of the bearing surface 4, the second part comprising a complementary portion of the bearing surface 4 and a second flange 2G' with no reinforcement, means for connecting the two parts 2G, 2G' of the frame 1G being arranged at the level of the bearing surface 4.

The means for connecting these two frame parts are constituted by an extension 8G*a* of the reinforcement 8G of the first frame part extending beyond its part of the bearing surface 4 so as to exit freely therefrom in order to cooperate with a corresponding housing 4*b* provided in the other portion of the bearing surface 4 of the second part of the frame 1G.

The immobilization of the reinforcement part 8G*a* in the housing 4*b* is done by any means, in this case by a screw 11. The advantage of such an embodiment is that the frame can be made more simply in two parts and that the assembly of these two parts can easily be obtained by inserting one of the parts.

Figure 6:
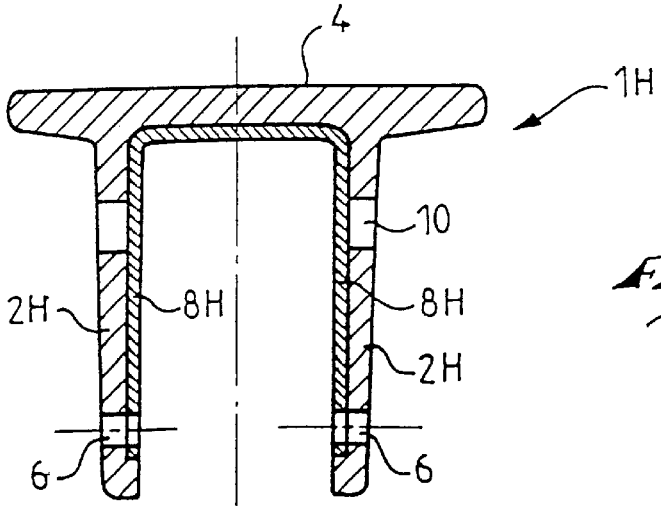
Figure 7:
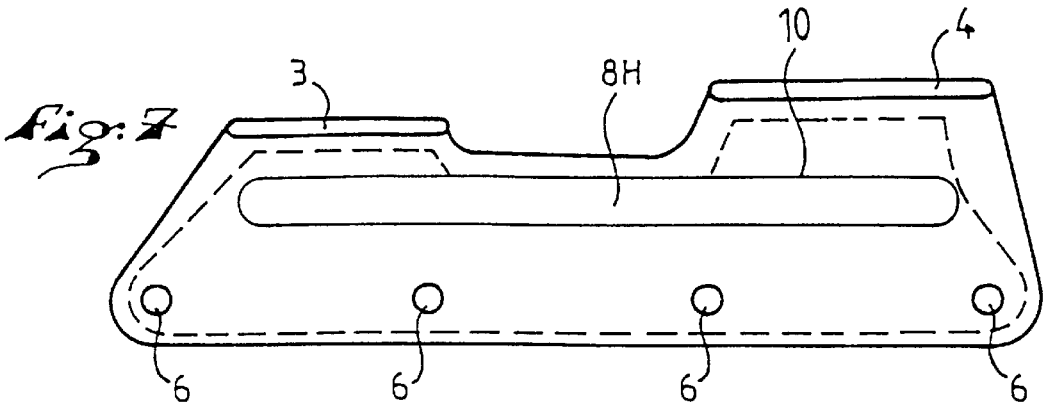
FIG. 7 is a side view of a frame made according to the embodiment of FIG. 6.

In the frame 1H, according to the example of FIG. 6, the reinforcement 8H forms a U extending in an apparent way on the internal surfaces of the U formed by the parallel arms of the flanges 2H, and by the bearing plane 4 connecting them.

According to this same example, at least one of the lateral flanges 2H comprises a longitudinal window 10 for visualizing the reinforcement 8H.

It is noted that the reinforcements can also be made of composite materials (glass fibers, carbon fibers, etc.).

Figure 8:
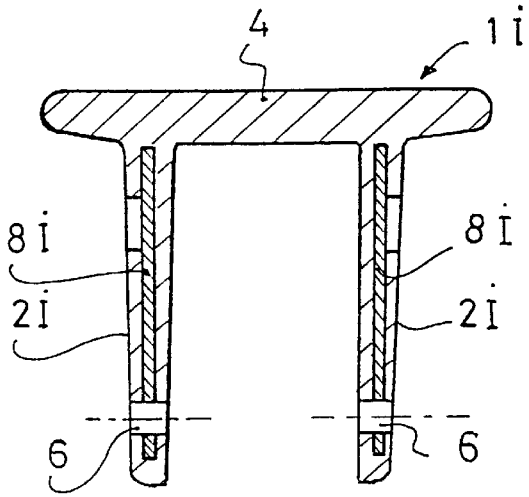
FIGS. 8–15 are transverse cross-sectional views according to other embodiments.

In the example of FIG. 8, the frame 11 comprises reinforcements 81 constituted by two distinct planar elements extending inside the lateral flanges 21 and whose ends extend beyond the end portions of the flanges pierced with holes 6.

Figure 9:
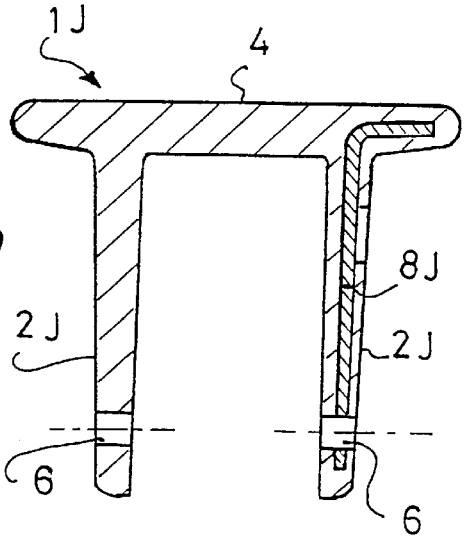

According to the example of FIG. 9, the frame IJ comprises a reinforcement 8J constituted by a single planar element extending inside a single lateral flange 2J and whose upper end is bent perpendicularly towards the outside to locally reinforce the bearing plane 3, 4, and whose lower end extends beyond the end portion of the flange 2J pierced with a hole 6.

It is noted that the essential difference between the example of FIG. 9 and FIG. 8 lies in the asymmetry of that of FIG. 9. However, in the two cases, the reinforcements 8I and 8J are metallic, whereas the rest of the structure, and especially the flanges 2I and 2J, are plastic.

Figure 10:
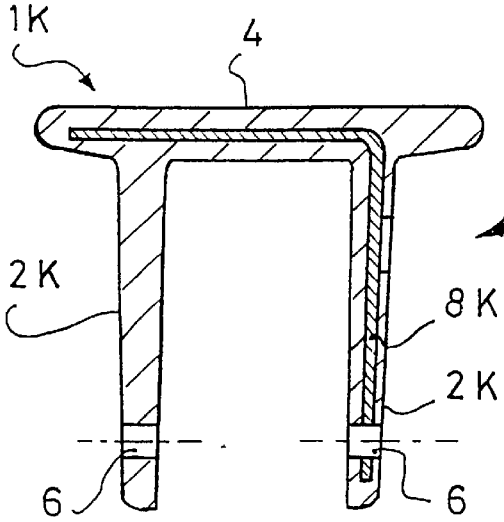

According to the example of FIG. 10, the frame 1K comprises a reinforcement 8K constituted by an orthogonal element, one end of which extends inside one of the flanges 2K, beyond its end part pierced with holes 6, and another part extends inside the bearing surface 3, 4. Also, in this case, the reinforcement 8K is metal, whereas the rest of the structure is plastic.

Figure 11:
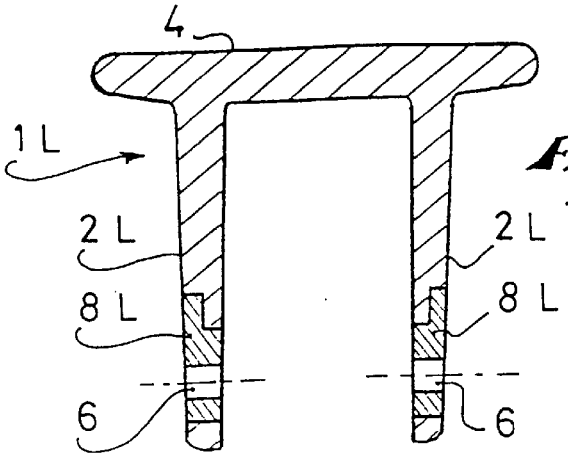

According to the example of FIG. 11, the frame 1L comprises reinforcements 8L constituted by two distinct elements extending inside the flanges on either side of the end holes 6 of the flanges 2L. In this case, the reinforcements 8L are made of hard plastic, whereas the rest of the structure is made of more flexible plastic. They can also be metallic.

Figure 12:
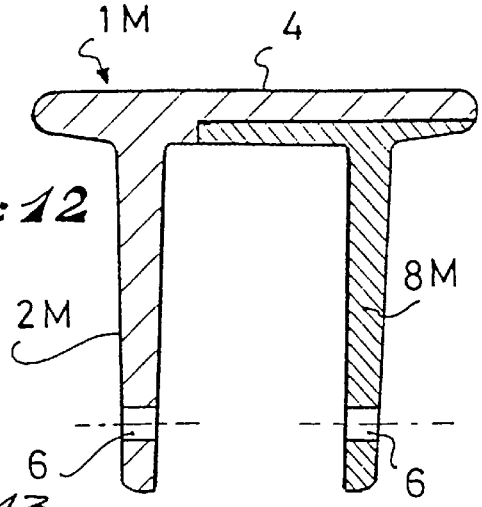

According to the example of FIG. 12, the frame 1M comprises a reinforcement 8M, itself constituting one of the structure flanges, and extending perpendicularly to constitute a lower part of the bearing plane 3, 4, cooperating with an upper part of the same plane which extends perpendicularly to constitute the other flange, the structure being made by co-injection of two different plastic materials. In this case, the reinforcement 8M constituting one of the flanges is made of a relatively rigid plastic, and the rest of the structure is made of a more flexible plastic.

Figure 13:
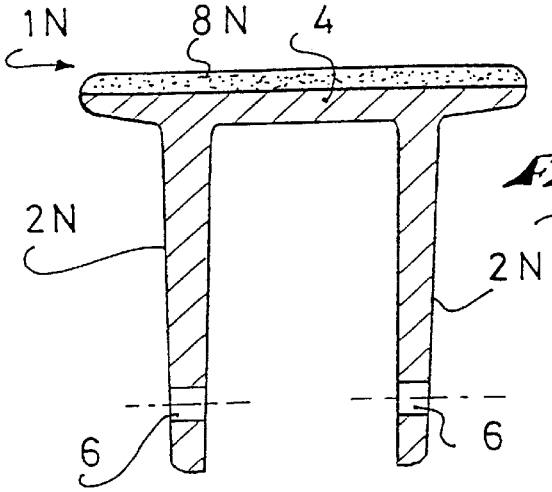

According to the example of FIG. 13, the frame IN differs essentially from the preceding ones in that the flanges 2N are made of a rigid plastic material that does not require a reinforcement, but a flexible dampening part 8N is made of a "foamed" plastic layer and molded onto the bearing plane 3, 4 of the structure.

Figure 14:
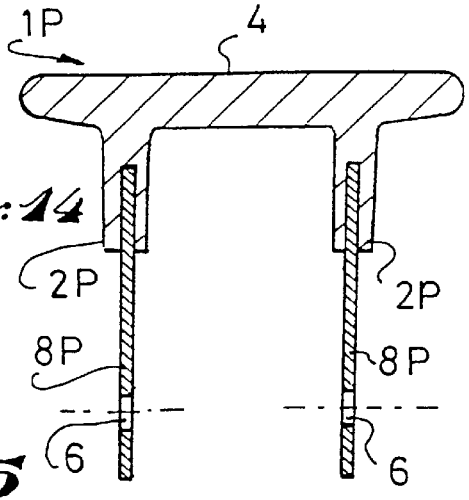

According to the example of FIG. 14, the frame 1P comprises reinforcements 8P constituted by two distinct elements extending partly inside the shortened flanges 2P and partly outside the latter to constitute their end pierced with holes 6. In this case, the reinforcements 8P are metallic, whereas the rest of the structure is plastic.

Figure 15:
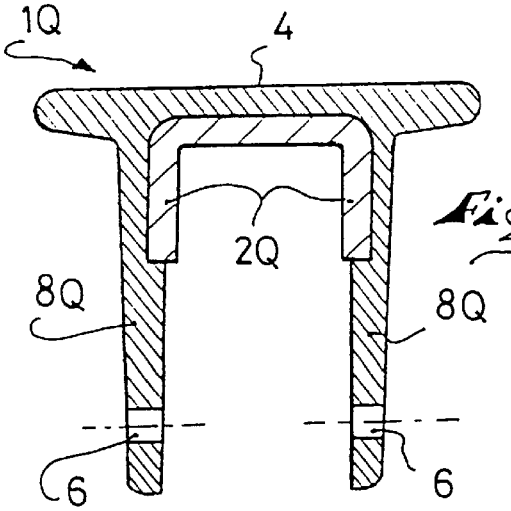

According to the example of FIG. 15, the frame 1Q comprises a reinforcement 8Q constituted by a U-shaped element covering the shortened flanges 2Q and the bearing plane 3, 4, and extending beyond the flanges to constitute the end of the latter pierced with holes 6. In this case, the reinforcements 8Q are made of a relatively rigid plastic, whereas the flanges 2Q and the bearing plane 4 are made of a more flexible plastic.

According to another essential characteristic of the invention, the reinforcements 8, according to all the previously described examples, extend, as needed, in a variable way, along the transverse axis and/or longitudinal axis of the structure.

Figure 16:
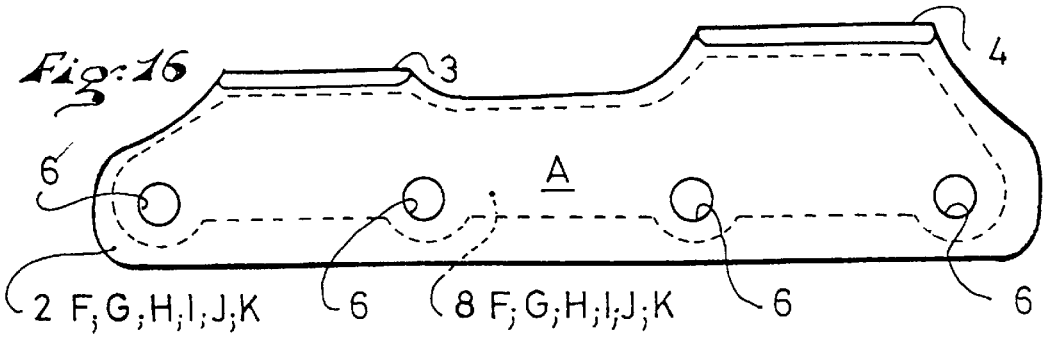
FIGS. 16–20 are longitudinal views of a frame according to alternative embodiments.

Thus, according to the example of FIG. 16, the flanges 2F, 2G, 2H, 2I, 2J, 2K are provided with at least one lateral reinforcement 8F, 8G, 8H, 8I, 8J, 8K constituting a zone A and extending partially into one corresponding flange along the longitudinal axis, so as to reinforce the structure at the level of at least one hole 6 of the wheel. In this case, this lateral reinforcement extends over the quasi-totality of the flange and all of the holes 6.

Figure 17:
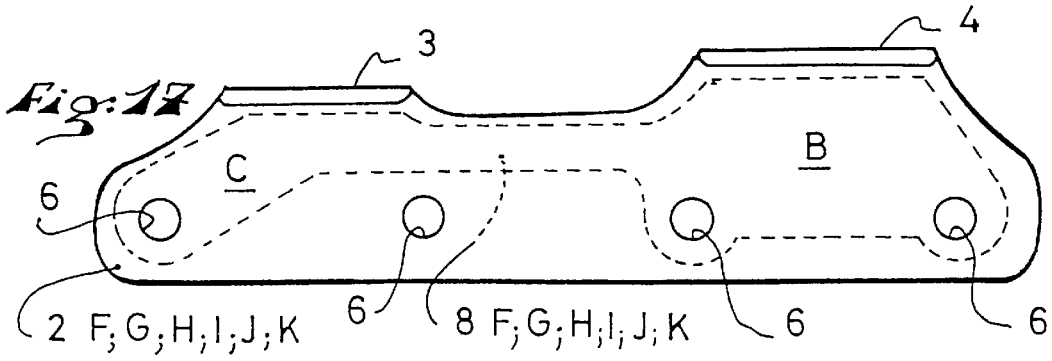

However, according to the example of FIG. 17, which in fact shows two possible examples, at least one lateral reinforcement B and C extends partially into one corresponding flange along the longitudinal axis, so as to reinforce the structure at the level of at least one hole 6 of a wheel. It is noted that in the case of a reinforcement covering a zone B, the latter reinforces a corresponding zone covering two holes 6, whereas according to another case illustrated by a reinforcement which would be constituted by the zones B and C, the reinforcement would reinforce the structure in the corresponding zones, but also at the level of three of the holes 6 of the wheels.

Figure 18:
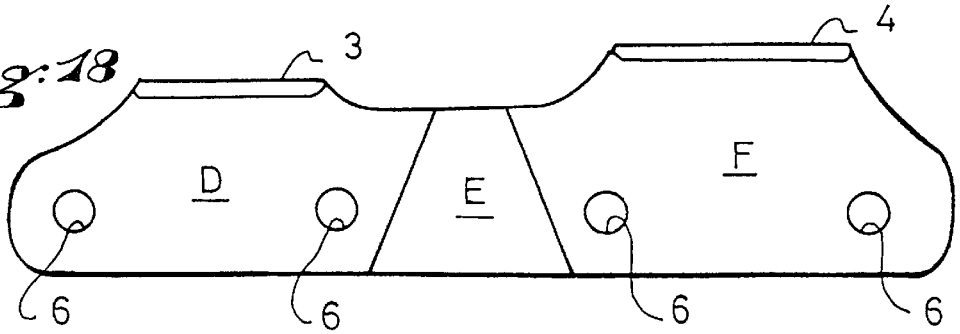

According to the example of FIG. 18, two rigid reinforcements D, F are integrated in at least one of the flanges, reinforcing the structure at the level of the wheels and separated in the longitudinal direction by a complementary intermediate element E made of a relatively flexible material constituting an elastically deformable zone of the frame extending over its whole height.

Figure 19:
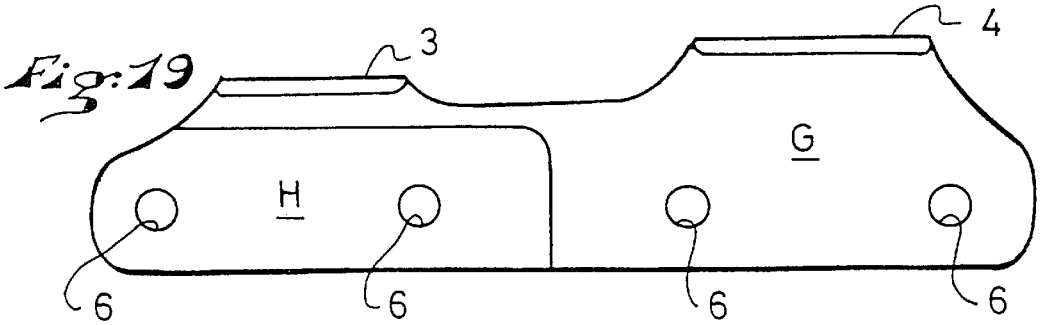

According to the example of FIG. 19, a rigid reinforcement G is integrated in at least one of the flanges, reinforcing the structure towards the rear and extending beyond the ends of the flanges pierced with holes and generally constituting the bearing plane 3, 4, a complementary end element H made of a more flexible material constituting the front of the structure and also extending beyond the end holes of the flanges.

Figure 20:
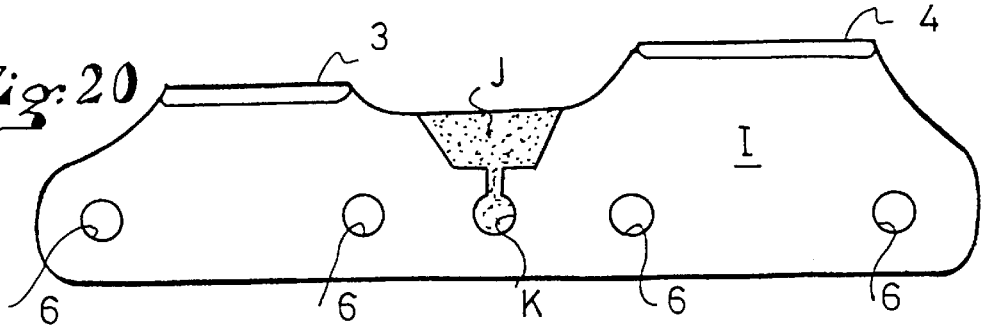

According to a last embodiment example shown in FIG. 20, a reinforcement I made of a relatively rigid material is integrated in at least one of the flanges, and has an upper cutout in which, in the longitudinal direction, a complementary intermediate element J made of a relatively flexible material is integrated, which constitutes an elastically deformable zone extending in a corresponding upper zone of the frame. The reinforcement I and the complementary intermediate element J will not necessarily be made of different materials. In this example, several intermediate elements distributed longitudinally over the frame can also be envisioned.

The rigid reinforcement I comprises at the lower end of the cutout, in which the soft element J is integrated, a recess K constituting a flexion zone of the frame.

Of course, all combinations of materials can be envisioned regardless of the previously described examples. Likewise, the distribution of different materials, as much in the longitudinal direction as in the transverse direction, can be envisioned.

What is claimed is:

1. A roller skate frame comprising:

a longitudinally extending boot-supporting structure comprising a front platform and a rear platform, said front platform comprising a front boot-supporting surface and said rear platform comprising a rear boot-supporting surface, said front and roar boot-supporting surfaces being longitudinally spaced apart;

a par of laterally spaced-apart longitudinally extending flanges, said flanges extending downwardly from said front platform and from said rear platform and integrally formed therewith, said flanges extending longitudinally between said front platform and said rear platform, at least said pair of flanges comprising a plastic material; and a single reinforcement member for said plastic material, said single reinforcement member being at least partially molded within or onto said plastic material of each of said pair of flanges, said reinforcement member being configured to support a plurality of longitudinally spaced apart wheel axles.

2. A frame according to claim 1, wherein:

said reinforcement member is at least party molded within said flanges by co-injection of two different plastic materials.

3. A frame according to claim 2, wherein:

said pair of lateral flanges are substantially parallel, said front platform and said lateral flanges forming a U-shape, and said rear platform and said lateral flanges forming a U-shape;

said reinforcement member itself constitutes one of said pair of lateral flanges of the frame and extends substantially perpendicularly to constitute a lower part of at least one of said front and rear platforms which cooperates with an upper part of said one of said front and rear platforms, said reinforcement member further being extended substantially perpendicularly to constitute a second of said pair of lateral flanges.

4. A frame according to claim 1, wherein:

said reinforcement member is metallic and a remainder of the frame is plastic.

5. A frame according to claim 4, wherein:

at least one of said pair of lateral flanges includes a longitudinal window for extending from an outer surface of said one of said lateral flanges to said reinforcement member for viewing said reinforcement member.

6. A frame according to claim 1, wherein:

said reinforcement member is metallic, said reinforcement member being made by cutting and stamping.

7. A frame according to claim 6, wherein:

said reinforcement member comprises a lower portion provided with a bored and threaded boss, thereby being configured to support said plurality of longitudinally paced apart wheels.

8. A frame according to claim 6, whet:

said pair of lateral flanges are substantially parallel, said front platform and said lateral flanges forming a U-shape, and said rear platform and said lateral flanges forming a U-shape;

said reinforcement member is constituted by a U-shaped element, said reinforcement member including a base covering at least one of said front and rear platforms and having downwardly extending shortened flanges, said lateral flanges of the frame extending downwardly beyond said shortened flanges of said reinforcement member, said lateral flanges of the frame having holes extending therethrough beneath said shortened flanges of said reinforcement member, said holes comprising means for supporting said plurality of spaced apart wheel axles.

9. A frame according to claim 1, wherein:

said reinforcement member comprises at least one stiffening rib.

10. A frame according to claim 1, wherein:

said pair of lateral flanges comprise a pair of substantially parallel lateral flanges, at least one of said front and rear platforms being formed integrally with said par1liel lateral flanges, said parallel lateral flanges and said at least one of said front and rear platforms forming a U-shape by molding of a plastic material, covering said reinforcement member by molding or co-injection, said reinforcement member being metallic or a plastic different from said plastic, embedded onto or into said at least one of said front and rear platforms.

11. A frame according to claim 1, wherein:

said pair of lateral flanges are substantially parallel, said lateral flanges and at least one of said front and rear platforms forming a U-shape, said pair of lateral flanges and said at least one of said front and rear platforms being made by molding or co-injection of said plastic around said reinforcement member, said reinforcement member being made of metal or a plastic different from said plastic, arranged inside or outside said flanges.

12. A frame according to claim 11, wherein:

each of said lateral flanges includes a threaded hole for attaching respective ones of said wheel axles;

said reinforcement member has a U-shape extending within said at least one of said front and rear platforms, beneath said surface of said one of said front and rear platforms, and inside of said lateral flanges, said reinforcement member having ends within said lateral flanges, said ends of said reinforcement member located above said threaded holes of said lateral flanges.

13. A frame according to claim 11, wherein:

said reinforcement member has a U-shape extending within said at least one of said front and rear platforms, beneath said surface of said one of said front and rear platforms, said U-shape of said reinforcement member including legs extending downwardly inside of said lateral flanges; and a threaded hole extending through each of said lateral flanges and through each of said legs of said U-shape of said reinforcement member for attaching a respective one of said plurality of wheel axles.

14. A frame according to claim 11, wherein:

said reinforcement member forms a U-shape extending on internal surfaces of said U-shape formed by said lateral flanges and said one of said front and rear platforms.

15. A frame according to claim 11, wherein:

said reinforcement member is constituted by a single planar element extending inside a single lateral flange, said single planar element having an upper end bent perpendicularly towards the outside of the frame to locally reinforce a respective boot supporting surface of at least one of said front and rear platforms, said single planar element having a lower end extending beyond an end part of said flange pierced with a hole.

16. A frame according to claim 1, wherein:

said reinforcement member does not extend laterally outside of either of said flanges.

17. A roller skate frame comprising:

a longitudinally extending boot-supporting structure comprising a front platform and a rear platform, said front platform comprising a front boot-supporting surface and said rear platform comprising a rear boot-supporting surface, said front and rear boot-supporting surfaces being longitudinally spaced apart;

a pair of laterally spaced-apart longitudinally extending flanges, said flanges extending downwardly from said front platform and from said rear platform and integrally formed therewith, said flanges extending longitudinally between said front platform and said rear platform, at least said pair of flanges comprising a plastic material; and a pair of reinforcement members for said plastic material, each said reinforcement member being at least partially molded within or onto a respective one of said plastic material of each of said pair of flanges, each said reinforcement member being configured to support a plurality of longitudinally spaced apart wheel axles.

18. A frame according to claim 17, wherein:

said pair of reinforcement members are at least partially molded within or onto said flanges by co-injection of two different plastic materials.

19. A frame according to claim 18, wherein:

said pair of lateral flanges are substantially parallel, said front platform and said lateral flanges forming a U-shape, and said rear platform and said lateral flanges forming a U-shape;

said pair of reinforcement members themselves constitute said pair of lateral flanges of the frame and extend substantially perpendicularly to constitute a lower part of at least one of said front and rear platforms which cooperates with an upper part of said one of said front and rear platforms.

20. A frame according to claim 17, wherein:

said pair of reinforcement members are metallic and a remainder of the frame is plastic.

21. A frame according to claim 20, wherein:

at least one of said pair of lateral flanges includes a longitudinal window for extending from an outer surface of said one of said lateral flanges to a respective one of said reinforcement members for viewing said respective reinforcement member.

22. A frame according to claim 17, wherein:

said pair of reinforcement members are metallic, said reinforcement members being made by cutting and stamping.

23. A frame according to claim 22, wherein:

each of said pair of reinforcement members comprises a respective lower portion provided with a bored and threaded boss, thereby being configured to support said plurality of longitudinally spaced apart wheels.

24. A frame according to claim 22, wherein:

said pair of lateral flanges are substantially parallel, said front platform and said lateral flanges forming a U-shape, and said rear platform and said lateral flanges forming a U-shape;

said pair of reinforcement members are part of a U-shaped reinforcement element, said U-shaped reinforcement element including a base covering at least one of said front and rear platforms and having downwardly extending shortened flanges, said lateral flanges of the frame extending downwardly beyond said shortened flanges of said pair of reinforcement members, said lateral flanges of the frame having holes extending therethrough beneath said shortened flanges of said pair of reinforcement members, said holes comprising means for supporting said plurality of spaced apart wheel axles.

25. A frame according to claim 17, wherein:

at least one of said reinforcement members comprises at least one stiffening rib.

26. A frame according to claim 17, wherein:

said pair of lateral flanges comprise a pair of substantially parallel lateral flanges, at least one of said front and rear platforms being formed integrally with said parallel lateral flanges, said parallel lateral flanges and said at least one of said front and rear platforms forming a U-shape by molding of a plastic material, covering said reinforcement members by molding or co-injection, said reinforcement members being metallic or a plastic different from said plastic, embedded onto or into said at least one of said front and rear platforms.

27. A frame according to claim 17, wherein:

said pair of lateral flanges are substantially parallel, said lateral flanges and at least one of said front and rear platforms forming a U-shape, said pair of lateral flanges and said at least one of said front and rear platforms being made by molding or co-injection of said plastic around said pair of reinforcement members, said pair of reinforcement members being made of metal or a plastic different from said plastic, arranged inside or outside said flanges.

28. A frame according to claim 27, wherein:

each of said lateral flanges includes a laded hole for attaching restive ones of said wheel axles;

said pair of reinforcement members being part of a U-shape, a part of said U-shape extending within said at least one of said front and rear platforms, beneath said surface of said one of said front and rear platforms, and inside of said lateral flanges, said pair of reinforcement members having ends within said lateral flanges, said ends of said reinforcement members located above said threaded holes of said lateral flanges.

29. A frame according to claim 27, wherein:

said pair of reinforcement members being part of a U-shape, a part of said U-shape extending within said at least one of said front and rear platforms, beneath said surface of said one of said front and rear platforms, said U-shape of said reinforcement members including legs extending downwardly inside of said lateral flanges; and a threaded hole extending through each of said lateral flanges and through each of said legs of said U-shape of said reinforcement members for attaching a respective one of said plurality of wheel axles.

30. A frame according to claim 27, wherein:

the frame is constituted of two separable parts, a first of said two parts integrating said reinforcement members, said reinforcement members being molded in a first portion of at least one of said front and tar platforms and one of said lateral flanges, a second of said two part comprising a complementary second portion of said at least one of said front and rear platforms and a second of said lateral flanges, said second of said lateral flanges having no reinforcement, a means for connecting said first and said second of said two parts of said frame being arranged at the level of said at least one of said front and rear platforms.

31. A frame according to claim 30, wherein:

said means for connecting said two parts are constituted by an extension of at least one of said reinforcement members of said first part extending beyond said first portion of said at least one of said front and rear platforms so as to extend freely therefrom to cooperate with a corresponding housing positioned in said second portion of said at least one of said front and rear platforms of said second part of the frame.

32. A frame according to claim 27, wherein:

said pair of reinforcement members forms part of a U-shape extending on internal surfaces of said U-shape formed by said lateral flanges and said one of said front and rear platforms.

33. A frame according to claim 27, wherein:

said pair of reinforcement members extend inside of said lateral flanges, said reinforcement members having ends extending beyond end parts of said lateral flanges pierced with holes, said holes comprising means for supporting said plurality of longitudinally spaced apart wheel axles.

34. A frame according to claim 27, wherein:

said reinforcement members extend partly inside of said flanges and partly outside of said flanges to form ends of said flanges, said ends of said flanges having holes extending therethrough, said holes comprising said means for attaching said plurality of longitudinally spaced apart wheels.

35. A frame according to claim 17, wherein:

said reinforcement members extend only in a substantially vertical direction.

36. A frame according to claim 17, wherein:

said reinforcement members do not extend laterally outside of either of said flanges.

37. A frame according to claim 17, wherein:

said reinforcement members reinforces only said flanges.

38. A frame according to claim 17, wherein:

said lateral flange are substantially parallel, at least one of said front and rear platforms and said lateral flanges forming a U-shape;

a hole in a lower end of each respective one of said lateral flanges is provided for supporting said plurality of longitudinally spaced apart wheels;

said reinforcement members extend inside respective ones of said lateral flanges, on either side of said holes of said lateral flanges.

39. A frame according to claim 17, wherein:

said pair of reinforcement members extend in a variable way transversely and/or longitudinally of the frame.

40. A frame according to claim 39, wherein:

holes are provided, extending through said lateral flanges, for securing said plurality of wheel axles;

each of said lateral reinforcement members extends longitudinally partially along a corresponding one of said lateral flanges, so as to reinforce the frame at at least one of said holes.

41. A frame according to claim 39, wherein:

at least one of said front and rear platforms, together with said lateral flanges, form a U-shape;

holes are provided through said lateral flanges for attaching said plurality of wheel axles;

said reinforcement members comprise two rigid integrated reinforcements, reinforcing the frame in an area of said holes, said two rigid integrated reinforcements being separated longitudinally by a complementary intermediate element made of a relatively flexible material constituting an elastically deformable zone of the frame extending over an entirety of a height of the frame.

42. A frame according to claim 39, wherein:

at least one of said front and rear platforms, together with said lateral flanges, form a U-shape;

holes are provided through said lateral flanges for attaching said plurality of wheel axles;

said reinforcement members comprise two rigid integrated reinforcements, reinforcing the frame in a rear portion of the frame and extending beyond ends of said holes of said late flanges and generally constituting said at least one of said front and rear platforms, a complementary end element made of a more flexible material constituting a front of the frame and also extending beyond said end holes of said lateral flanges.

43. A frame according to claim 39, wherein:

at least one of said front and rear platforms, together with said lateral flanges, form a U-shape;

holes are provided through said lateral flanges for attaching said plurality of wheel axles;

said reinforcement members comprise two reinforcement members made of a relatively rigid material and integrated in said lateral flanges, said reinforcement members having at least one upper cutout, a complementary intermediate element made of a relatively flexible material being longitudinally integrated in the frame, said intermediate element constituting an elastically deformable zone extending in a corresponding upper zone of the frame.

44. A frame according to claim 43, wherein:

each of said rigid reinforcement members comprises, at a lower part of said cutout, a recess constituting a flexion zone of the frame.

* * * * *